US006523831B2

(12) United States Patent
Webb

(10) Patent No.: US 6,523,831 B2
(45) **Date of Patent: *Feb. 25, 2003**

(54) METHOD AND APPARATUS FOR PLAYING BLACKJACK WITH A THREE CARD POKER WAGER ("21+3/4")

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,517

(22) Filed: Aug. 1, 2001

(65) Prior Publication Data

US 2002/0000693 A1 Jan. 3, 2002

Related U.S. Application Data

(60) Continuation-in-part of application No. 09/464,778, filed on Dec. 16, 1999, which is a continuation-in-part of application No. 09/118,067, filed on Jul. 17, 1998, now Pat. No. 6,012,719, which is a continuation-in-part of application No. 08/889,919, filed on Jul. 10, 1997, now Pat. No. 6,056,641, which is a division of application No. 08/504,023, filed on Jul. 19, 1995, now Pat. No. 5,685,774.

(51) Int. Cl.[7] ..... A63F 1/00

(52) U.S. Cl. ..... 273/292; 273/294; 273/306; 273/309; 463/12; 463/13; 463/26

(58) Field of Search ..... 273/292, 294, 273/309, 306; 463/12, 13, 26

(56) References Cited

U.S. PATENT DOCUMENTS 4,743,022 A 5/1988 Wood
4,836,553 A 6/1989 Suttle et al.
5,098,107 A 3/1992 Boylan et al.
5,174,579 A 12/1992 Griffiths
5,257,784 A 11/1993 Boylan et al.
5,257,810 A 11/1993 Schorr et al.
5,265,877 A 11/1993 Boylan et al.
5,275,415 A 1/1994 Wisted
5,288,081 A 2/1994 Breeding
5,294,128 A 3/1994 Marquez
5,308,065 A 5/1994 Bridgeman et al.
5,366,228 A 11/1994 Kangsanaraks
5,377,973 A 1/1995 Jones et al.
5,377,993 A 1/1995 Josephs
5,431,408 A 7/1995 Adams
5,489,101 A 2/1996 Moody
5,531,448 A 7/1996 Moody (List continued on next page.)

*Primary Examiner*—Benjamin H. Layno
*Assistant Examiner*—Dolores R. Collins
(74) *Attorney, Agent, or Firm*—Nixon & Vanderhye P.C.

(57) ABSTRACT

Card games that combine the play of Blackjack ("21") with a 3-card Poker wager or side bet ("21+3/4"). Each player places a basic Blackjack wager and an optional side wager before the cards are dealt. Each player is then dealt a card with the dealer receiving a face-up card. Each player is dealt a second card. At this point, the outcome of each 3-card hand is determined, where a 3-card hand consists of the 2-card hand dealt to that player and the dealer's face-up card. In a 4-card version, each 4-card hand consists of the 2-card hand dealt to the player, the dealer's face-up card, and the dealer's hole card. After settling the 3-card wagers, the game of Blackjack continues in a typical fashion. After exposing the dealer's hole card, 4-card wagers are then settled. The invention advantageously retains all the features and advantages of Blackjack as well as provides the dynamics of a proposition game, without interfering with the card sequence, for enhanced player anticipation and enjoyment.

27 Claims, 1 Drawing Sheet

U.S. PATENT DOCUMENTS 5,538,252 A 7/1996 Green
5,584,486 A 12/1996 Franklin
5,630,757 A 5/1997 Gagin et al.
5,653,444 A 8/1997 Dahl
5,673,917 A 10/1997 Vancura
5,678,821 A 10/1997 Hedman
5,685,774 A * 11/1997 Webb ..... 273/292
5,732,950 A 3/1998 Moody
5,743,530 A 4/1998 Sklad et al.
5,839,730 A 11/1998 Pike
5,873,571 A 2/1999 Vaisman et al.
6,012,719 A * 1/2000 Webb ..... 273/292
6,056,641 A * 5/2000 Webb ..... 273/292
6,293,551 B1 * 9/2001 Webb ..... 273/274
6,371,867 B1 * 4/2002 Webb ..... 463/12

* cited by examiner

METHOD AND APPARATUS FOR PLAYING BLACKJACK WITH A THREE CARD POKER WAGER ("21+3/4")

CROSS-REFERENCES TO RELATED APPLICATIONS

This is a continuation-in-part of U.S. patent application Ser. No. 09/464,778, filed Dec. 16, 1999; which is a continuation-in-part of U.S. patent application Ser. No. 09/118,067, filed Jul. 17, 1998, now U.S. Pat. No. 6,012,719; which is a continuation-in-part of U.S. patent application Ser. No. 08/889,919, filed Jul. 10, 1997, now U.S. Pat. No. 6,056,641; which is a division of U.S. patent application Ser. No. 08/504,023, filed Jul. 19, 1995, now U.S. Pat. No. 5,685,774.

STATEMENT REGARDING FEDERALLY SPONSORED RESEARCH OR DEVELOPMENT (NOT APPLICABLE)

BACKGROUND OF THE INVENTION

The invention relates to card games. More particularly, the invention relates to Blackjack variant card games.

With the expansion of gaming and the increase in competition, casinos are striving to offer a wider variety of games. The growth in slot machine popularity and the increase in variety of specialty games has resulted in the overall reduction in conventional Blackjack ("21") tables.

Many casinos, however, are reluctant to further reduce the number of Blackjack tables because of the inherent game attractiveness to both players and casinos. The game is based on simple concepts and procedures that are readily understood by casual and regular players alike. In addition, the game allows players to use basic strategies that provide some degree of player control and that allow for heightened excitement. For the casino operators, the game requires relatively low overhead to facilitate and monitor.

In an attempt to accommodate the desire for variety and the retention of a significant Blackjack presence, several Blackjack variant games have been introduced. These games include Multiple Action Blackjack, Spanish 21, Face-Up 21, and Royal Match. See, e.g., U.S. Pat. No. 5,673,917 to Vancura. Although Blackjack variants typically provide additional waging options, these games tend to either negatively alter the flow of the Blackjack game or add very little game dynamics. Another Blackjack variant is Action Gaming's 21 Stud. In this game, each player has the option of placing a side wager in addition to the basic Blackjack wager. The side wager is a bet that a dealer's 5-card hand will be above a certain rank and has a variable payoff scale according to rank. Since a Blackjack player may be satisfied with a hand before being dealt 5-cards (e.g., when the player is dealt an Ace and a Jack for the first two cards), 21 Stud provides for a dealer settling all Blackjack wagers after standing or busting. The game then allows the dealer to draw extra cards, if necessary until having a total of 5 cards. The dealer's first 5 cards form a Poker hand. A standing hand occurs on the odd occasions that more than 5 cards were required for the dealer to reach 17 or more.

21 Stud, however, has several drawbacks. Firstly, because all players with the side wager are betting on the same outcome, the game is very volatile. Secondly, with the range of payoff odds required with a 5-card game, there is a risk of a high payoff amount. Accordingly, the game will likely never be offered with a $1 side bet and may require extra surveillance. Thirdly, the Blackjack hand is the primary part of the game for the majority of players. However, Blackjack wagers are settled first, so the potential anticipatory thrill time is lower on the primary wager. Fourthly, when 5-card hands are dealt face-up, one at a time, there is usually very little excitement because after 3 cards it is often obvious that a premium hand cannot be created. For example when the first 3 cards dealt are 10, 5, and 2 (off-suit), no straight, flush, full house or better are possible. Fifthly, and probably most significantly, the dealer is usually required to take extra cards. This aspect of the game is particularly problematic because it slows the game down and deters potential players who are generally adverse to waiting for other players or the dealer from taking additional cards and those potential players who do not like the run of cards to be altered.

BRIEF SUMMARY OF THE INVENTION

The invention provides card games that combine the play of Blackjack ("21") with a 3-card Poker wager ("21+3"). In a casino embodiment, the invention can be played in conjunction with a conventional Blackjack casino-type table and a single standard deck of 52 playing cards. The table surface not only has the regular Blackjack bet area, but also an extra bet area for an optional 3- or 4-card side wager. In such an embodiment, the table also displays a payoff scale on the side wager and further instructional and promotional information.

At the beginning of a game, each player places a basic Blackjack wager and an optional 3- or 4-card side wager. A dealer deals each player a card, with the dealer receiving a face-up card. Each player also receives a second card. In the 3-card context, a player's 3-card hand consists of the 2-card hand dealt to that player and the dealer's face-up card. At this point, the outcomes of the 3-card hands are determined. In one embodiment of the invention, Poker rankings such as a pair or better ("Pair Plus") are used to determine a winning hand. Other defining criteria such as card color may alternatively be used to determine a winning hand. After settling the side wagers, the game of Blackjack continues. In the 4-card context, a player's 4-card hand consists of the 2-card hand dealt to that player and the dealer's 2-card hand. The 4-card side wagers are settled after the dealer exposes the dealer hole card.

The invention advantageously retains all the features and advantages of Blackjack (and Blackjack variants) as well as provides the dynamics of a 3- or 4-card side wager, without interfering with the card sequence, for enhanced player anticipation and enjoyment. The invention thus benefits the player who desires a Pair Plus or proposition type of game as well as the player who does not want to leave a Blackjack game, but desires some variety. In addition, the invention provides casino operators with added revenue generating features without requiring additional casino tables, space, or extra game surveillance.

Another feature of the invention is that it can be practiced with a variety of Blackjack deck modes including double deck, four-deck, six-deck, and eight-deck, with each mode having an appropriate payoff scale.

With the 21+3/4 scenario, mathematical probability principles dictate that as the number of decks increases, the frequency of different hand ranks varies. For example, with an increasing number of decks, the relative frequencies of a straight flush and a straight decreases, whereas the relative frequency of three of a kind, flush and pair increases, while the overall frequency of a pair or better also increases. It is thus difficult to have a standard payoff scale for each of the common varieties of Blackjack, including single deck, double deck, four-deck, six-deck and eight-deck.

Such varying payoff scales are not desirable to casino operators, and players may be disenchanted with the lower multiple deck payoff scales. Moreover, a game incorporating more generous payoff scales with fewer decks may be susceptible to player skill techniques such as card counting, shuffle tracking and card locating. Thus, a payoff scale that is constant irrespective of the number of decks would satisfy casino operators' concerns. With the standard bet payoff, the house advantage would be readily adjusted according to the number of decks; that is, higher for fewer decks and lower for more decks. As a consequence, as vulnerability to skill techniques increases with the smaller number of decks, the house advantage also increases and vice versa. Vulnerability to skill techniques could also be eliminated by using a constant shuffling machine.

The invention can be readily implemented in a wide variety of additional forms and media including, single player slot video machines, multi-player slot video machines, electronic games and devices, lottery terminals, scratch-card formats, software as well as in-flight, home, and Internet entertainment. Moreover, the invention can be readily implemented in software, which can be stored on a disk (e.g., magnetic disk, compact disc (CD), etc.) and used with a computer system.

The foregoing, and other features and advantages of the invention, will be apparent from the following, more particular description of the preferred embodiments of the invention, the accompanying drawing, and the appended claims.

DETAILED DESCRIPTION OF THE INVENTION

Figure 1:
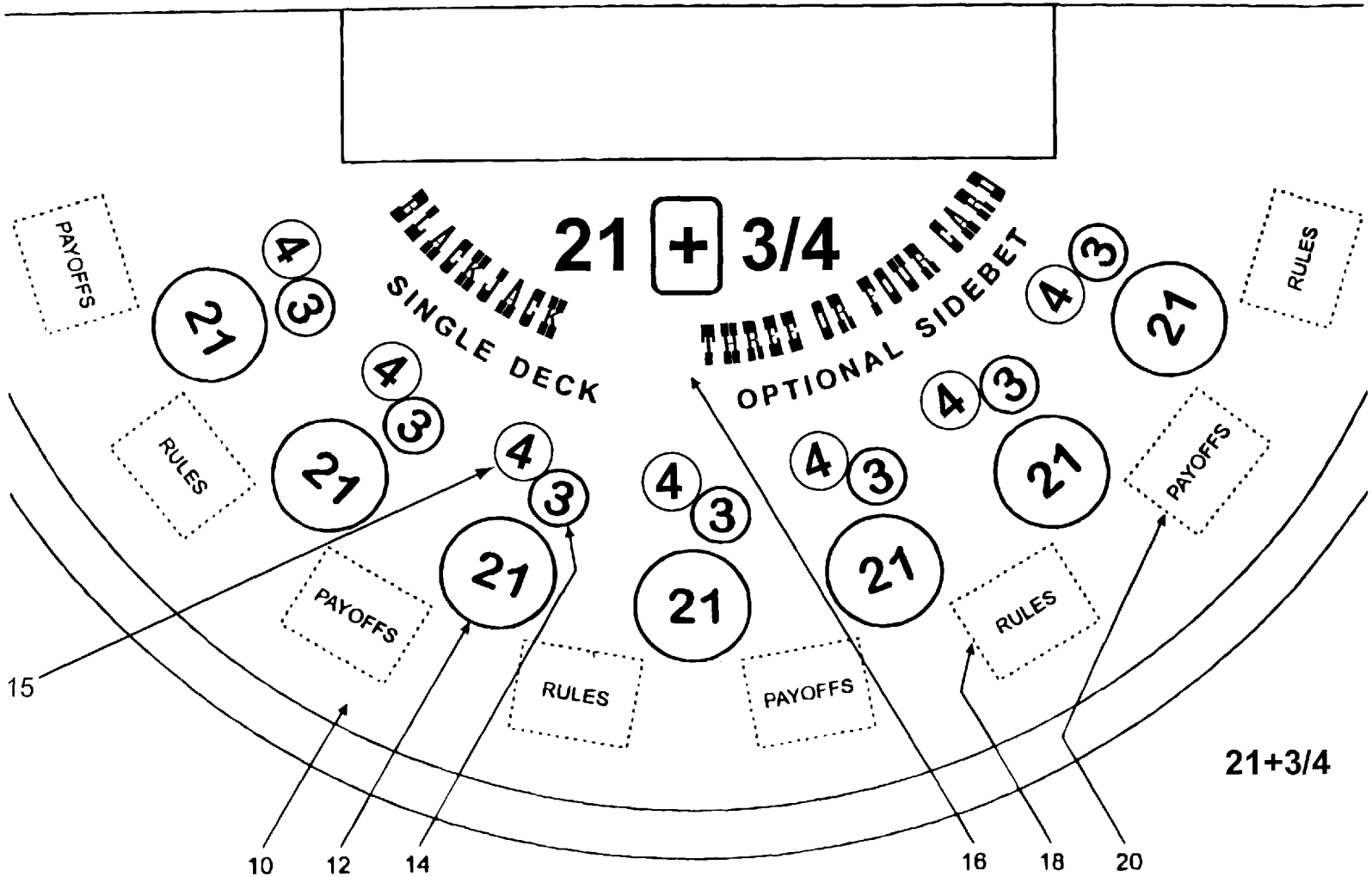
FIG. 1 illustrates a playing surface (layout) of a casino-type table in accordance with the invention.

The invention provides card games that combine the play of Blackjack ("21") with a 3- or 4-card side wager ("21+3/4"). The first preferred embodiment of the invention is used in connection with a casino-type Blackjack table and a single standard deck of 52 playing cards. FIG. 1 illustrates a playing surface (layout) 10 of the Blackjack table which includes a primary betting area 12 for each of a plurality of players, which in this embodiment is seven players. Primary betting area 12 is used for the placement of a Blackjack wager. Play surface 10 also includes a secondary betting area 14, corresponding with each area 12, for an optional 3-card side wager and a tertiary betting area 15 corresponding with each area 12, for an optional 4-card side wager. In addition, playing surface 10 includes a dealer area 16, displays of a predetermined payoff scale 20, and displays of predetermined game rules 18. As would be apparent to one skilled in the relevant art, the predetermined payoff scales and game rules used in a particular embodiment can be based on the teachings of the invention and well known gaming principles and casino specific requirements. Other wager areas and/or information can be displayed on playing surface 10, such as the "21+3/4" promotional markings illustrated in FIG. 1.

In this preferred embodiment, each player must place a Blackjack wager at betting area 12 in order to participate in the game. Each player, however, has the option to place an additional 3-card side wager at betting area 14 and/or an additional 4-card side wager at betting area 15. In another embodiment of the invention, both the Blackjack and side wagers are required and in yet another embodiment only the side wager is required. Additional wagers and wager features can be practiced with the invention.

The allowable limit of the side wagers (placed in areas 14, 15) is preferably governed by both predetermined game rules 20 and the Blackjack wager (placed in area 12). For example, with each player having a separate hand and with a payoff scale with a highest payoff similar to Craps or Roulette, an embodiment of the invention can be operated with a minimum side wager equal to a table minimum for Blackjack, typically $5 or more. In addition, a maximum side wager for a player can be set to the first hand side wager made by that player after each shuffle or at the beginning of that shoe. This would negate the impact of well known techniques such as card counting, shuffle tracking, and card locating used by proficient players.

Once the wagers have been placed, a dealer then deals, in rotation, each player a first card and the dealer receives a face-up card. Each player, again in rotation, is then dealt a second card and the dealer receives a second or hole card (face-down). Alternatively, the second face-down card can be retained in the deck. In accordance with the invention, a 3-card side wager hand consists of the 2-card hand that player was dealt and the dealer's face-up card. A 4-card side wager hand, described in more detail below, consists of the 2-card hand that player was dealt and the 2-card hand dealt to the dealer. The side wager variants described herein including a 3-card side wager and a 4-card side wager are not mutually exclusive but could be included in a game offering both side wagers. Alternatively, the game could include only the 3-card side wager or only the 4-card side wager. The different side wagers will be described separately for ease of illustration.

In the 3-card only variant, the outcomes of the 3-card wagers are then determined and settled prior to continuing with the Blackjack game. In one embodiment, a player wins the 3-card side wager according to Poker rankings with a pair or better ("Pair Plus"), as disclosed in U.S. Pat. No. 6,056,641, the disclosure of which is incorporated herein by reference. The following delineates hand ranking of this embodiment (wherein Ace, King, Queen, Jack, and 10 are represented as "A", "K", "Q", "J", and "T", respectively; "sss" indicates that the three cards are of the same suit (i.e., all diamonds, hearts, spades, or clubs); and the reference "in sequence" does not denote the order in which the cards were received by a player, but the actual relationship of the three cards together):

Winning 3-Card Hands

| | |
|---|---|
| Straight Flush | Three cards of one suit in sequence (e.g., A K Q sss; T 9 8 sss; 3 2 A sss) |
| Three of a Kind | Three cards of the same rank, whether suited or not (e.g., J J J; 4, 4, 4; or 7 7 7 sss with multiple deck embodiments) |
| Straight | Three cards in sequence (e.g., A K Q; 6 5 4; 3 2 A) |
| Flush | Three cards of the same suit (including pairs or not, but not including three of a kind) (e.g., T 8 6 sss; K Q 3 sss; or 5 5 9 sss with multiple deck embodiments) |
| Pair | Two cards of the same rank (but not when all three are suited with multiple deck embodiments) (e.g., 9 9 5; 8 8 T ; 6 6 7) |

Losing 3-Card Hands

High card only

None of the above (e.g., K Q 2; J T 3).

The 3-card wagers are now settled. If the player has a losing 3-card hand, their bet (from area 14) is removed. If the player has a winning 3-card Poker hand, they are paid in accordance with the predetermined game rules, predetermined payoff scale, and the amount of their bet placed in area 14. In this single deck embodiment, the payoff scale is as follows:

| | |
|---|---|
| Straight Flush | 35 to 1 |
| Three of a Kind | 33 to 1 |
| Straight | 6 to 1 |
| Flush | 4 to 1 |
| Pair | 1 to 1. |

As would be apparent to one skilled in the relevant art, alternative payoff scales (e.g., in accordance with the particular casino requirements) can be practiced with the invention. In addition, multiple decks including double deck, four-deck, six-deck, and eight-deck modes can be used with appropriate predetermined payoff scales. For multiple deck embodiments of the invention, exact hand rankings should be determined for two-way hands. The following illustrates a couple of instances of two-way hands:

Two-Way Hands Examples

A) The 3-card Poker hand consisting of King Diamonds, King Diamonds, and Queen Diamonds, could be either:
   Option 1: Pair,
   Option 2: Flush, or
   Option 3: Flush/Pair.

B) The 3-card Poker hand consisting of King Diamonds, King Diamonds, and King Diamonds, could either:
   Option 1: Flush,
   Option 2: Three of a Kind, or
   Option 3: Flush/Three of a Kind.

In each instance, the 3-card Poker hand constitutes any of the options. Within a particular game, however, the two-way should be consistently resolved. For example, the same option (i.e., Option 1, 2, or 3) should be used in both instances A and B above. In another embodiment of the invention, the superior of the two regular hand ranks (i.e., Option 2 for both instances above) is chosen to avoid creating additional hand ranks. As would be apparent to one skilled in the relevant art, a wide range of payoff scales for multiple deck games can be used with the present invention.

In an alternative embodiment of the invention, a player wins the 3-card side wager only upon the occurrence of a flush or better. As a consequence of the operating mode according to this embodiment of the invention, a constant payoff scale can be set irrespective of the number of decks played. In a first version, the 3-card side wager pays 9 to 1 for a flush or better. In an alternative version, a flush or better pays 7 to 1 for the 3-card side wager, and a pair or better pushes the wager.

In a preferred alternative embodiment according to the present invention, a player wins the 3-card side wager according to a predetermined defining criteria. For example, a player may win the 3-card side wager when all three cards are the same color. Other examples may include all three cards being face cards (i.e., Jacks, Queens or Kings), all three cards being higher than a certain number such as 9, all three cards being lower than a certain number such as 6, etc. Those of ordinary skill in the art will contemplate many viable alternatives for the defining criteria, and the invention is not necessarily meant to be limited to one particular criteria. In the color example, the 3-card side wager pays 3 to 1 when all cards are the same color (i.e., all red or all black).

After settling the 3-card wagers, the dealer proceeds with a Blackjack game. In this embodiment, the Blackjack game is conventional. However, other variant Blackjack games can be practiced with the invention. The Blackjack wagers are settled in accordance with well known principles and the particular aspects of the Blackjack (or Blackjack variant) game.

In the 4-card side wager variant, which as noted above may be provided in addition to the 3-card side wager or separately, a player wins the 4-card side wager when all of the four cards (player 2-card hand, dealer face-up card, and dealer hole card) share a predetermined defining criteria. In a preferred embodiment, the predetermined defining criteria is color but, like the 3-card embodiment described above, other defining criteria such as face cards, higher or lower than a particular number, etc. could also be used, and the invention is not necessarily meant to be limited to the preferred application.

The 4-card side wager may be desirable to players because of the potential for a high payout. When the defining criteria is color such that a winning side wager occurs when all four cards are the same color, the payout is preferably 7 to 1.

In operation, when the player makes a 4-card side wager at area 15, (e.g., a 4-card color wager), if the player's dealt 2-card hand and dealer face-up card are not the same color, then the wager is taken. If the player dealt 2-card hand and the dealer face-up card are the same color, then a red/black marker is placed by the player's color bet. Preferably, a two-sided marker can be used with red on one side and black on the other side. The marker is placed with the appropriate color face-up. The dealer then proceeds with a conventional Blackjack game, and all Blackjack hand decisions are completed. Next, as with conventional Blackjack, the dealer's hole card is exposed, and the 4-card color wagers are taken or paid according to the cards in the 4-card hand including the player's dealt 2-card hand, the dealer's face-up card and the dealer's now exposed hole card. Subsequently, the dealer's Blackjack hand is completed, and the Blackjack wagers are settled in accordance with well known principles and the particular aspects of the Blackjack (or Blackjack variant) game.

The invention advantageously retains all of the features and advantages of Blackjack as well as provides the dynamics of a proposition game side wager, without interfering with the card sequence, for enhanced player anticipation and enjoyment. The invention thus benefits the player who desires a Poker type or proposition game as well as the player who does not want to leave a Blackjack game, but desires some variety. In addition, the invention provides casino operators with additional revenue generating features for Blackjack with acceptable volatility.

Another predominate feature of the invention is that casino embodiments of invention do not require additional space or tables to practice the invention, rather the invention can be practiced with existing tables, preferably modified as illustrated in FIG. 1.

An additional feature is that the invention does not require any more game surveillance than a conventional Blackjack game.

As would be apparent to one skilled in the relevant art, the invention can be embodied in a wide variety of forms and media including, but not limited to, single player slot video machines, multi-player slot video machines, electronic games and devices, lottery terminals, scratch-card formats, software as well as in-flight, home, and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing a card game comprising:

(a) dealing two cards to a player and at least one card to a dealer;

(b) forming at least a 3-card hand including said two cards dealt to said player and said at least one card dealt to said dealer;

(c) resolving said at least 3-card hand according to a shared defining criteria; and (d) continuing with a Blackjack game.

2. A method according to claim 1, wherein the shared defining criteria is card color.

3. A method according to claim 2, wherein step (c) is practiced by declaring the player a winner when each of the cards in the at least 3-card hand is the same color.

4. A method according to claim 1, further comprising, prior to step (a), the step of receiving a side wager from said player.

5. A method according to claim 4, wherein step (c) is practiced by paying a payout based on the side wager when each of the cards in the at least 3-card hand matches the shared defining criteria.

6. A method according to claim 5, wherein the shared defining criteria is card color.

7. A method according to claim 6, wherein the payout is 3 to 1.

8. A method according to claim 6, wherein the payout is 7 to 1.

9. A method according to claim 1, wherein the at least one card dealt to said dealer comprises a dealer face-up card, and wherein step (b) is practiced by forming a 3-card hand including said two cards dealt to said player and said face-up card dealt to said dealer.

10. A method according to claim 9, further comprising, prior to step (a), the step of receiving a side wager from said player.

11. A method according to claim 10, wherein step (c) is practiced by paying a payout based on the side wager when each of the cards in said 3-card hand matches the shared defining criteria.

12. A method according to claim 11, wherein the shared defining criteria is card color.

13. A method according to claim 12, wherein the payout is 3 to 1.

14. A method according to claim 1, wherein step (d) is practiced prior to step (c).

15. A method according to claim 1, wherein the at least one card dealt to said dealer comprises a dealer face-up card and a dealer hole card, and wherein step (b) is practiced by forming a 4-card hand including said two cards dealt to said player, said dealer face-up card and said dealer hole card.

16. A method according to claim 15, further comprising, prior to step (a), the step of receiving a side wager from said player.

17. A method according to claim 16, wherein step (c) is practiced by paying a payout based on the side wager when each of the cards in said 4-card hand matches the shared defining criteria.

18. A method according to claim 17, wherein the shared defining criteria is card color.

19. A method according to claim 18, wherein the payout is 7 to 1.

20. A method according to claim 15, wherein step (a) is practiced by dealing said two cards to said player and dealing said dealer face-up card and said dealer hole card to said dealer, then practicing step (d), then practicing step (b) by forming said 4-card hand, then practicing step (c).

21. A method according to claim 1, wherein the at least one card dealt to said dealer comprises a dealer face-up card and a dealer hole card, the method further comprising, prior to step (a), the step of providing to the player an option for a 3-card hand side wager and a 4-card hand side wager, wherein step (b) is practiced by forming a 3-card hand including said two cards dealt to said player and said face-up card dealt to said dealer and by forming a 4-card hand including said two cards dealt to said player, said dealer face-up card and said dealer hole card, and wherein step (c) is practiced by paying a payout based on the side wager when each of the cards in at least one of the 3-card hand and the 4-card hand matches the shared defining criteria.

22. A method of playing a card game comprising:

(a) dealing two cards to a player and two cards to a dealer, the two dealer cards comprising a face-up card and a hole card;

(b) forming a 3-card hand including said two cards dealt to said player and said face-up card dealt to said dealer, and forming a 4-card hand including said two cards dealt to said player and said face-up card and said hole card dealt to said dealer;

(c) resolving said 3-card hand and said 4-card hand according to a shared defining criteria; and (d) continuing with a Blackjack game.

23. A method according to claim 22, wherein step (c) is practiced prior to step (d) with respect to the 3-card hand and after step (d) with respect to the 4-card hand.

24. A method according to claim 23, further comprising receiving at least one of a 3-card side wager and a 4-card side wager from said player.

25. A method according to claim 24, wherein step (c) is practiced by paying a payout based on the 3-card side wager when each of the cards in the 3-card hand matches the shared defining criteria and by paying a payout based on the 4-card side wager when each of the cards in the 4-card hand matches the shared defining criteria.

26. A method according to claim 25, wherein the shared defining criteria is card color.

27. A method according to claim 25, wherein the payout based on the 3-card wager is 3 to 1, and wherein the payout based on the 4-card wager is 7 to 1.

* * * * *